US007673984B2

(12) United States Patent
Nonaka

(10) Patent No.: US 7,673,984 B2
(45) Date of Patent: Mar. 9, 2010

(54) IMAGE FORMING APPARATUS HAVING A REMOVABLE OUTPUT UNIT

(75) Inventor: Manabu Nonaka, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 754 days.

(21) Appl. No.: 11/354,700

(22) Filed: Feb. 15, 2006

(65) Prior Publication Data

US 2006/0181590 A1 Aug. 17, 2006

(30) Foreign Application Priority Data

Feb. 16, 2005 (JP) ..... 2005-039658
Dec. 9, 2005 (JP) ..... 2005-355670

(51) Int. Cl.
*B65H 31/22* (2006.01)
*B65H 85/00* (2006.01)
*B65H 29/60* (2006.01)
*B41J 2/01* (2006.01)

(52) U.S. Cl. ..... 347/104; 400/647

(58) Field of Classification Search ..... 400/647, 400/647.1

See application file for complete search history.

(56) References Cited

U.S. PATENT DOCUMENTS 6,823,168 B2 * 11/2004 Sakuma ..... 399/405
2002/0159805 A1 * 10/2002 Sato ..... 399/405
2005/0232672 A1 * 10/2005 Nakamura et al. ..... 399/405

FOREIGN PATENT DOCUMENTS

| | | | |
|---|---|---|---|
| JP | 4-189169 | | 7/1992 |
| JP | 10-10819 | | 1/1998 |
| JP | 10330012 | A * | 12/1998 |
| JP | 11-79540 | | 3/1999 |
| JP | 2001-337499 | | 12/2001 |
| JP | 2002287445 | A * | 10/2002 |
| JP | 2003-137470 | | 5/2003 |
| JP | 2003131450 | A * | 5/2003 |
| JP | 2003-200598 | | 7/2003 |
| JP | 2005-263332 | | 9/2005 |
| JP | 2005-263341 | | 9/2005 |

* cited by examiner

*Primary Examiner*—Daniel J Colilla
(74) *Attorney, Agent, or Firm*—Cooper & Dunham, LLP

(57) ABSTRACT

An image forming apparatus includes an image forming section that discharges droplets of recording liquid to form an image on a recording medium, a body including the image forming section, and a conveyor section that conveys the recording medium having thereon the image formed in the image forming section. An output unit is removably attached to the body and includes at least the conveyor section. The output unit may further include a face-down output path, a straight output path, a straight output tray, and the like.

6 Claims, 7 Drawing Sheets

IMAGE FORMING APPARATUS HAVING A REMOVABLE OUTPUT UNIT

BACKGROUND

1. Technical Field

This specification generally relates to an apparatus that forms images, and more particularly describes an apparatus that forms images by discharging droplets of recording liquid.

2. Discussion of Related Art

An image forming apparatus, which may serve as a printer, a facsimile machine, a copier, or a combination thereof, forming images by using an electrophotographic process (i.e. electrophotographic image forming apparatus) is generally known. There is also known an ink-jet image forming apparatus that forms images by depositing droplets of recording liquid (i.e. ink droplets) on a conveyed recording medium.

In a background electrophotographic image forming apparatus, an output unit, to which sheets are output, may be removed from the electrophotographic image forming apparatus.

In another background electrophotographic image forming apparatus, a bottom of a sheet-output space is formed as an output tray, which may be removed from the electrophotographic image forming apparatus. Removing the output tray, a sheet-handling unit including an optional output unit and a sheet finisher may be removably mounted in the sheet-output space.

A background ink-jet image forming apparatus includes an ink cartridge connected to a record head via a channel, a feed tray from which a sheet is supplied, and an output tray to which a sheet after recording is output. The ink cartridge may be loaded or unloaded from a predetermined side of the image forming apparatus. The feed tray and the output tray are disposed so that a user may supply or pick up the sheet on the side from which the ink cartridge may be loaded or unloaded.

In another background electrophotographic image forming apparatus, a sheet output unit is removably attached to a top of the image forming apparatus. Removing the sheet output unit, an optional stacking unit may be removably attached to the top of the image forming apparatus. Further, the removed sheet output unit may be removably attached to a top of the optional stacking unit.

SUMMARY

An image forming apparatus is provided which includes an image forming section that discharges droplets of recording liquid to form an image on a recording medium, a body including the image forming section, and a conveyor section that conveys the recording medium having thereon the image formed in the image forming section. An output unit is removably attached to the body and includes at least the conveyor section.

The output unit has a novel and unobvious configuration which is adapted to be suitable particularly for image recording wherein droplets of recording liquid are deposited onto a recording medium to form a desired image thereon. For example, the output unit including the conveyor section is preferably detachable. Such an output unit allows it to be readily detached (and later reattached), for example, when the conveyance path becomes soiled with recording liquid and needs cleaning or otherwise needs maintenance.

For example, another one of the preferred features is that the output unit may further include, in addition to the conveyor section, a face-down output path, a straight output path, a straight output tray, and the like.

As another example, the straight output tray may be included along with the straight output path in a configuration wherein the straight output path is coupled to a straight conveyance path such that a sheet fed from a feed tray is linearly conveyed from feeding in, through the conveyance path and straight output path, onto the straight output tray.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
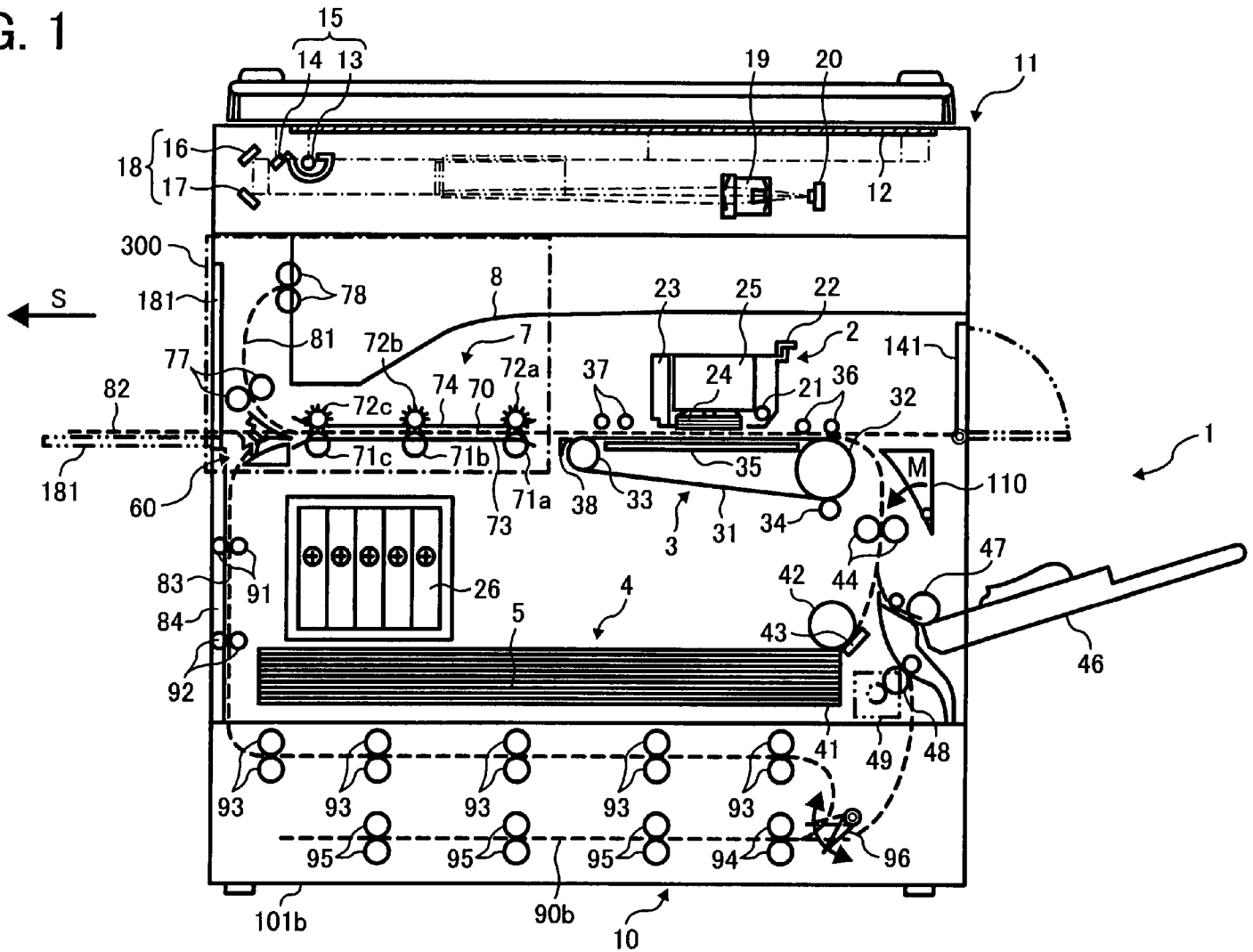
FIG. 1 is a schematic diagram illustrating an image forming apparatus according to an example in this disclosure.

In describing examples and preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an example of an image forming apparatus according to this disclosure is described.

As illustrated in FIG. 1, the image forming apparatus has a body 1 serving as a housing of the image forming apparatus. In the body 1, the image forming apparatus includes an image forming section 2, a sub-scanning section 3, a feeder section 4, an output-conveyor section 7, an output tray 8, a duplex unit 10, a single feed tray 141, and a straight output tray 181.

The feeder section 4, disposed at a lower portion of the image forming apparatus, stores a stack of recording medium and feeds the recording medium one by one.

The recording medium is hereafter referred to as a sheet 5; however, the recording medium need not be limited to a sheet and can include any possible form as a recording medium.

The sub-scanning section 3 conveys the sheet 5 so that the sheet 5 faces the image forming section 2 while the image forming section 2 discharges droplets to form a desired image.

When images are formed on a single side of the sheet 5, the sheet 5 is output to the output tray 8 disposed at an upper portion of the body 1 through the output-conveyor section 7.

When images are formed on both sides of the sheet 4, the sheet 5 is sent to the duplex unit 10 disposed at the bottom of the body 1 midway through the output-conveyor section 7. The duplex unit 10 serves as a switchback that reverses the sheet 5 and re-feeds the sheet 5 to the sub-scanning section 3.

After images are formed on both sides of the sheet 5, the sheet 5 is output to the output tray 8.

The sheet 5 may also be fed from the single feed tray 141 and output to the straight output tray 181.

Above the output tray 8, the image forming apparatus further includes an image reading section (i.e. a scanner section) 11. The image reading section 11 may read (i.e. input) image data (i.e. print data) to be formed by the image forming section 2.

The image reading section 11 has an exposure glass 12, an optical system 15 including a light source 13 and a mirror 14, an optical system 18 including mirrors 16 and 17, a lens 19, and an image capturing device 20.

The optical systems 15 and 18 move to scan (i.e. to read) an original image loaded on the exposure glass 12. The image capturing device 20 disposed behind the lens 19 captures the scanned image as image signals. The image signals are then digitized and image processed so that the image forming apparatus may print image processed print data.

The image forming apparatus may further include an interface (not shown) to receive data such as print data including image data from a host via a cable, a network, and the like. Examples of the host includes an external personal computer and other information processing apparatus, an image scanner and other image reading devices, a digital camera and other imaging devices. The image forming apparatus may process and print the received data.

Figure 2:
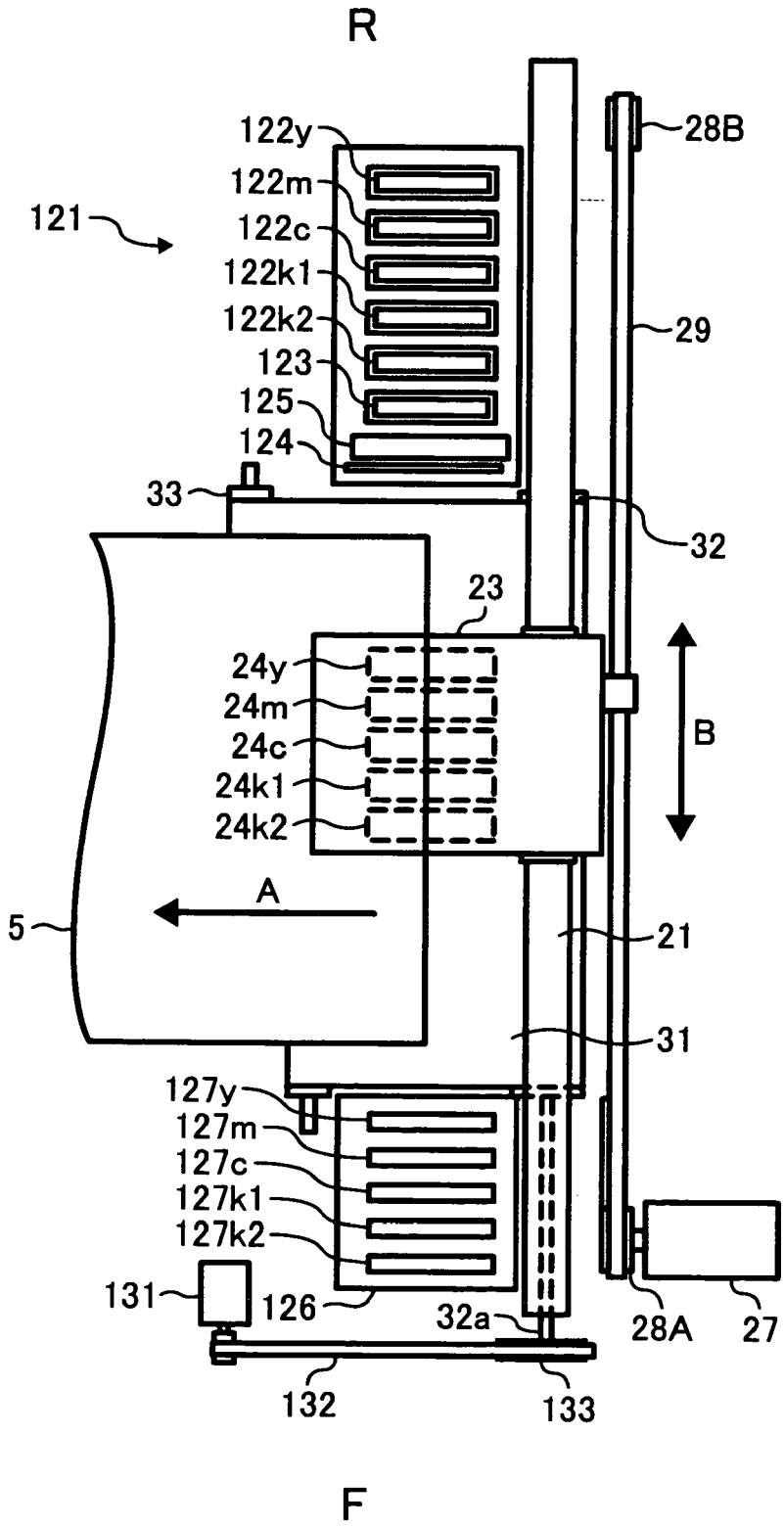
FIG. 2 is a top view of an image forming section and a sub-scanning section of the image forming apparatus of FIG. 1.

Also referring to FIG. 2, an example of the image forming section 2 of the image forming apparatus is now described. In FIG. 2, F indicates a front side of the image forming apparatus; R indicates a rear side. An arrow A indicates a direction to which a sheet is conveyed (i.e. the sub-scanning direction). An arrow B indicates a direction to and from which a carriage 23 scans (i.e. a main scanning direction).

The image forming section 2 can include a guide rod 21, a guide stay 22, the carriage 23, recording heads 24, a main-scan motor 27, a drive pulley 28A, a driven pulley 28B, a timing belt 29, a maintenance device 121, and a waste receiving member 126.

The guide rod 21 and the guide stay 22 may hold the carriage 23 such that the carriage 23 can move in the main scanning direction. The main-scan motor 27 causes the carriage 23 to scan in the main scanning direction via the timing belt 29 stretched between the drive pulley 28A and the driven pulley 28B.

The carriage 23 holds the recording heads 24, which may be formed of five droplet ejection heads 24*k*1, 24*k*2, 24*c*, 24*m*, and 24*y*. The droplet ejection heads 24*k*1 and 24*k*2 discharge black (Bk) ink droplets. The droplet ejection heads 24*c*, 24*m*, and 24*y* discharge cyan (C), magenta (M), yellow (Y) droplets, respectively. The droplet ejection heads 24*k*1, 24*k*2, 24*c*, 24*m*, and 24*y* are also hereafter collectively referred to as the recording heads 24.

As illustrated in FIG. 1, the carriage 23 holds sub-tanks 25, each of which supplies corresponding ink to the recording heads 24.

To a front side of the body 1, there is a cartridge housing into which ink cartridges 26 containing Bk, C, M, Y ink, respectively, may be detachably placed. Each of the ink cartridges 26 supplies ink to a corresponding sub-tank 25. Black ink is supplied from one ink cartridge 26 to the two sub-tanks 25.

The image forming apparatus of the example described above, employs a shuttle type image forming section in which the carriage 23 moves in the main scanning direction so that the recording heads 24 discharge ink droplets on the sheet 5, which is conveyed by the sub-scanning section 3 in the sheet-conveying direction (i.e. a sub-scanning direction). However, the image forming apparatus may employ other types of image forming section such as of a line type.

The recording heads 24 may be of a piezoelectric type, a thermal type, an electrostatic type, or the like. A piezoelectric type head discharges ink droplets by deforming a vibration plate forming a wall of an ink channel (i.e. a pressurization chamber) and changing a volume in the ink channel by using a piezoelectric element as a pressure generating device that pressurizes ink in the ink channel.

A thermal type head discharges ink droplets by heating ink in an ink channel using a heat-generating resistor so as to form a bubble.

An electrostatic head discharges ink droplets by placing a vibration plate that forms a wall of an ink channel to face an electrode so as to deform the vibration plate and to change a volume of the ink channel by an electrostatic force generated between the vibration plate and the electrode.

In FIG. 2, the maintenance device 121 is disposed on a side of the carriage scanning direction out of a printing area. The maintenance device 121 serves to maintain and recover a condition of nozzles of the recording heads 24. The maintenance device 121 includes five moisture retention caps 122*k*2, 122*k*1, 122*c*, 122*m*, and 122*y* (hereafter are also collectively referred to as moisture retention caps 122), a suction cap 123, a wiper blade 124, and a waste receiving member 125.

Each of the moisture retention caps 122*k*2, 122*k*1, 122*c*, 122*m*, and 122*y* covers a nozzle face of a corresponding one of the recording heads 24. The wiper blade 124 wipes the nozzle faces of the recording heads 24. The waste receiving member 125 receives ink droplets that are not used for forming an image (i.e. printing).

On the other side of the carriage scanning direction out of a printing area, there is the waste receiving member 126 into which the recording heads 24 may discharge ink droplets that are not used for forming an image. The waste receiving member 126 has five openings 127*k*2, 127*k*1, 127*c*, 127*m*, and 127*y* (hereafter may be collectively referred to as openings 127) formed thereon corresponding to each of the recording heads 24.

Figure 3:
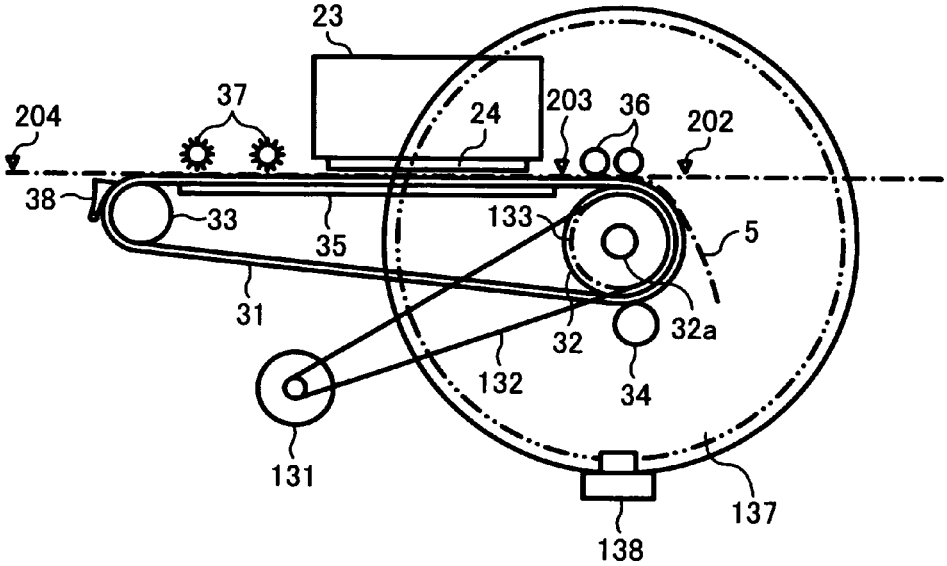
FIG. 3 is a side view of FIG. 2.

Also referring to FIG. 3, an example of the sub-scanning section 3 is now described. The sub-scanning section 3 can include a conveyor roller 32 having a shaft 32*a*, a driven roller 33, a conveyor belt 31, a charge roller 34, a guide member 35, two hold-down rollers (i.e. pressure rollers) 36, two toothed rollers 37, a separation claw 38, a sub-scanning motor 131, a timing roller 133, a code wheel 137, and a transmission type photo sensor 138.

The conveyor roller 32 serves as a drive roller and changes the direction of the sheet 5 at a substantially right angle such that the sheet 5 is conveyed facing the image forming section 2. The conveyor belt 31 is endlessly stretched forming a loop over the conveyor roller 32 and the driven roller 33. The driven roller 33 serves as a tension roller.

A high alternating voltage is applied to charge roller 34 from a high voltage power supply, and the charge roller may charge a surface of the conveyor belt 31.

The guide member 35 guides the conveyor belt 31 while facing the image forming section 2.

The two hold-down rollers 36 may press the sheet 5 against the conveyor belt 31 at a position facing the conveyor roller 32. The toothed rollers 37 may press a top face of the sheet 5, on which an image is formed by the image forming section 2. The separation claw 38 serves to separate the sheet 5 having an image formed thereon from the conveyor belt 31.

The conveyor belt 31 is rotated in the sheet-conveying direction (i.e. the sub-scanning direction) by the conveyor roller 32, which is rotated by the sub-scanning motor 131 via the timing belt 132 and the timing roller 133.

The conveyor belt 31 may have, but is not limited to, a double layer structure. A top layer serves as a layer attracting the sheet 5 and may be formed by a pure resin material of which resistance is not controlled such as an ETFE pure material. A back layer (i.e. a medium resistance layer or a grounding layer) may be formed of a same material as the top layer of which resistance is controlled using carbon, for example.

It should be noted that the conveyor belt 31 may be formed of a single layer, or three or more layers.

The code wheel 137 having a high resolution may further be attached to the shaft 32*a* of the conveyor roller 32. The transmission type photo sensor 138 detects a slit (not shown) formed on the code wheel 137 thus forming a rotary encoder.

Referring back to FIG. 1, an example of the feeder section 4 is now described. The feeder section 4 can include a sheet cassette 41, a pickup roller 42, a friction pad 43, a registration roller pair 44, a manual feed tray 46, a pickup roller 47, a conveyor roller 48, and a feed motor 49.

The sheet cassette 41 may contain a stack of sheets 5 and may be removable from a front side of the body 1. The sheet cassette 41 may be provided in plurality. The pickup roller 42 together with the friction pad 43 may separate and pick up a single sheet (i.e. the sheet 5) from the sheet cassette 41 to feed the sheet 5 toward the registration roller pair 44.

The manual feed tray 46 may contain a stack of sheets 5. When the sheet 5 is fed from the manual feed tray 46, the pickup roller 47 picks up a single sheet (i.e. the sheet 5) from the manual feed tray 46 and feeds the sheet 5 toward the registration roller pair 44.

When the sheet 5 is fed from the duplex unit 10 described below or an optional sheet cassette (not shown) that can be attached below the body 1, the conveyor roller 48 may convey the sheet 5 toward the registration roller pair 44.

The registration roller pair 44 may register the fed sheet 5 and send the sheet 5 toward the sub-scanning section 3.

The feed motor 49 may be formed of an HB stepping motor. Members that convey the sheet 5 to the sub-scanning section 3, such as the pickup rollers 42 and 47, the registration roller pair 44, and the conveyor roller 48, may be rotationally driven by the feed motor 49 via an electromagnetic clutch (not shown).

Between the registration roller pair 44 and an entrance of the sub-scanning section 3 (i.e. between the conveyor roller 32 and the hold-down rollers 36), there is provided a movable guide plate 110 to allow a loop (i.e. a slack) in the sheet 5 so that a back tension on the sheet 5 is prevented.

The registration roller pair 44 may receive the sheet 5 from the sheet cassette 41, the manual feed tray 46, or the duplex unit 10. Then the registration roller pair 44 may send the sheet 5 toward the sub-scanning section 3 while the movable guide plate 110 swings in a direction of an arrow M to guide the sheet 5 as shown in the FIG. 1. When the sheet 5 reaches the sub-scanning section 3, the movable guide plate 110 returns to an original state to allow a loop to be formed.

The single feed tray 141 may be disposed on a side of the body 1. The single feed tray 141 may be pivotally opened and closed from the body 1. When the single sheet 5 is manually fed, the single feed tray 141 is opened as shown in a virtual line (i.e. a dotted line) in FIG. 1. The sheet 5 fed from the single feed tray 141 is guided by a top face of the movable guide plate 110 so as to be directly and linearly inserted between the conveyor roller 32 and the hold-down rollers 36 in the sub-scanning section 3.

Next, an example of the output-conveyor section 7 is described. The output-conveyor section 7 has three conveyor rollers 71*a*, 71*b*, 71*c* (hereafter collectively may be referred to as conveyor rollers 71), three toothed wheels 72*a*, 72*b*, 72*c* (hereafter collectively may be referred to as toothed wheels 72) facing the conveyor rollers 71, a lower guide member 73, an upper guide member 74, a face-down roller pair 77, and an output roller pair 78.

The conveyor rollers 71 and the toothed wheels 72 may convey the sheet 5 that has been separated by the separation claw 38 in the sub-scanning section 3. The lower and upper guide members 73 and 74 guide the sheet 5 while being conveyed between the conveyor rollers 71 and the toothed wheels 72. The upper guide member 74 also serves to hold the toothed wheels 72 and may be opened and closed.

A path through which the sheet 5 is conveyed between the lower and upper guide members 73 and 74 is referred to as a conveyance path 70. A distance of the conveyance path 70 shall be determined so as to take an enough time for the sheet 5 to be appropriately dried. That is, the sheet 5 is preferably dried to be output without the formed image being subject to problems such as rubbing.

At an exit portion of the conveyance path 70, there is disposed a diversion mechanism 60 that can divide the conveyance path 70 into three paths: a first path (i.e. a face-down output path) 81 toward the output tray 8, a second path (i.e. a straight output path) 82 toward the straight output tray 181, and a third path (i.e. a duplex output path) 83 toward the duplex unit 10.

When the first path 81 is taken, the face-down roller pair 77 and the output roller pair 78 may convey the sheet 5 sent from between the lower and upper guide members 73 and 74 so as to output the sheet 5 onto the output tray 8 with its face down through a first path 81.

The straight output tray 181 is disposed on a side of the body 1 and performs a straight-through output of the image-formed sheet 5 with its face up. The straight output tray 181 may be pivotally opened and closed from the body 1. By opening the straight output tray 181 as shown in a virtual line in FIG. 1, the second path 82 is formed so that the sheet 5 is linearly conveyed toward the straight output tray 181.

By using the single feed tray 141 described above and the straight output tray 181, a sheet which is not suitable for curved conveyance or which does not quickly dry, such as an overhead transparency (OHP) film and a relatively thick sheet, may be linearly conveyed from the single feed tray 141 to the straight output tray 181. Linear conveyance can reduce problems such as a rubbing of an image and a sheet jam. Needless to say, a normal sheet such as plain paper may also be fed from the single feed tray 141 and linearly output to the straight output tray 181.

The third path 83 is located on a side of the body 1 and sends the sheet 5, diverged by the diversion mechanism 60, downward into the duplex unit 10. The third path 83 includes an entrance roller pair 91 and an exit roller pair 92 that convey the sheet 5. There is disposed a duplex guide plate 84 on a side of the body 1 to form the third path 83.

The duplex unit 10 has an intake path 90*a* and a switchback path 90*b*. The intake path 90*a* includes five duplex roller pairs 93 to horizontally convey the sheet 5 fed from the third path 83.

The switchback path 90*b* has a duplex output roller pair 94 and three duplex roller pairs formed of reverse rollers that serves to reverse the sheet 5 fed from the intake path 90*a* and re-feed the sheet 5 toward the conveyor roller 48.

There is a diversion plate 96 that may swing to switch paths between a path from the intake path 90*a* to the switchback path 90*b* and a path from the switchback path 90*b* to the conveyor roller 48. The diversion plate 96 may swing between a position shown in a solid line in FIG. 1, which sends the sheet 5 to the switchback path 90*b*, and a position shown in a dotted line, which re-feeds the sheet 5 to the conveyor roller 48.

When the sheet 5 sent from the duplex unit 10 reaches the conveyor roller 48, the conveyor roller 48 conveys the sheet 5 to the registration roller pair 44 as described above.

Figure 4:
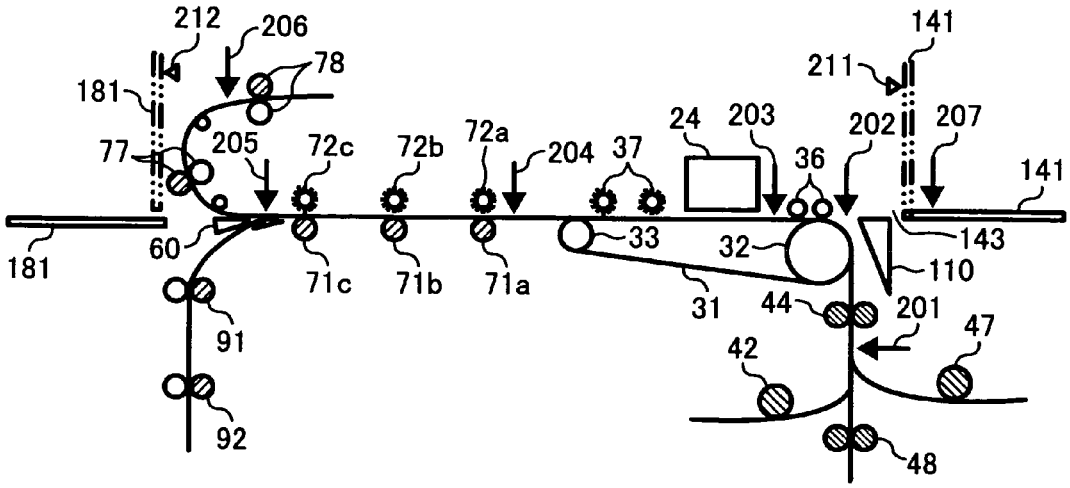
FIG. 4 is an illustration of sheet conveyance paths and sensors in the image forming apparatus of FIG. 1.

Referring now to FIG. 4, exemplary locations of various sensors are described. As illustrated, the sensors that detect the sheet 5 can include a conveyance registration sensor 201, an entrance sensor 202, an image registration sensor 203, an exit sensor 204, a diversion sensor 205, an output sensor 206, and a sheet presence sensor 207.

The conveyance registration sensor 201 is located upstream of the registration roller pair 44. The entrance sensor 202 is located upstream of the conveyor roller 32 and an upstream roller of the hold-down rollers 36. The image registration sensor 203 is located downstream of a downstream roller of the hold-down roller 36, that is, an entrance of the image forming section 2, to register a start-of-write position of an image. The exit sensor 204 is located at an exit of the image forming section 2, which is upstream of the conveyor roller 71a. The diversion sensor 205 is located at the diversion mechanism 60. The output sensor 206 is located upstream of the output roller pair 78. The sheet presence sensor 207 is located on the single feed tray 141 to detect a placement of the sheet 5 on the single feed tray 141.

There are further provided open-close detection sensors 211 and 212 that detect open and close operations of the single feed tray 141 and the straight output tray 181, respectively. Although not being shown, there may further be provided a duplex entrance sensor at an exit portion of the intake path 90*a* of the duplex unit 10, and a switchback sensor between an exit of the intake path 90*a* and an entrance of the switchback path 90*b*.

Next, an operation of the image forming apparatus is briefly described.

An alternating high voltage, which is a positive and negative rectangular wave, is applied to the charge roller 34 from an AC bias supply unit (not shown). Since the charge roller 34 is in contact with an insulating layer (i.e. the top layer) of the conveyor belt 31, a positive charge and a negative charge are alternately applied to the top layer of the conveyor belt 31 forming a stripe of positive and negative charge in a conveyance direction of the conveyor belt 31. In this manner, the top layer of the conveyor belt 31 is charged with a predetermined charge width, thus generating a non-uniform electric field.

Then the sheet 5 is fed from any one of the sheet cassette 4, the manual feed tray 46, the duplex unit 10, the single feed tray 141, and the like onto the non-uniformly charged conveyor belt 31. Due to the non-uniform electric field, the sheet 5 is polarized in a direction of the electric field immediately after being sent on the conveyor belt 31. As a result, the sheet 5 may be attracted to the conveyor belt 31 to be conveyed with the movement of the conveyor belt 31.

While the sheet 5 is intermittently conveyed by the conveyor belt 31, droplets of recording liquid are discharged onto the sheet 4 from the recording head 24 according to print data so that an image is formed (i.e. printed).

After the image is formed, a leading edge of the sheet 5 is separated from the conveyor belt 31 by the separation claw 38. Then the sheet 5 is conveyed by the output-conveyor section 7 and appropriately output to the output tray 8 or the straight output tray 181, or alternatively, sent to the duplex unit 10 so that the sheet 5 is output after an image is formed on the other side of the sheet 5.

In an example of the image forming apparatus described above, the output-conveyor section 7, the straight output tray 181, the duplex guide plate 84, and the like can be formed as a unit, which is also hereafter referred to as an output unit 300.

In an example as illustrated in FIG. 1, the output unit 300 may be drawn out of the body 1 in a direction of an arrow S. The output unit 300 may be pushed into the body 1 in a direction opposite to the arrow S.

Figure 5:
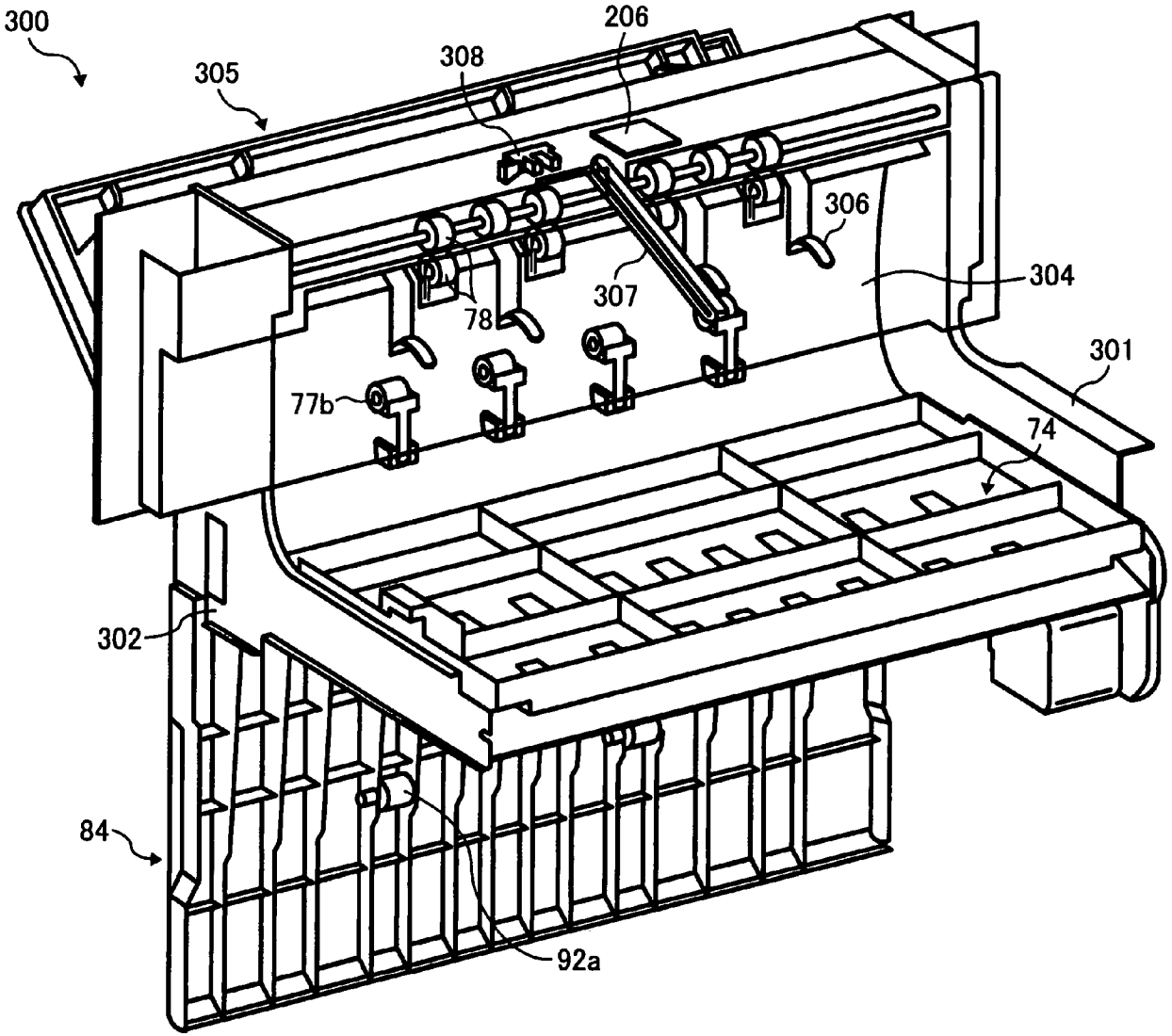
FIG. 5 is a perspective front view of an output unit removed from the image forming apparatus of FIG. 1.
Figure 6:
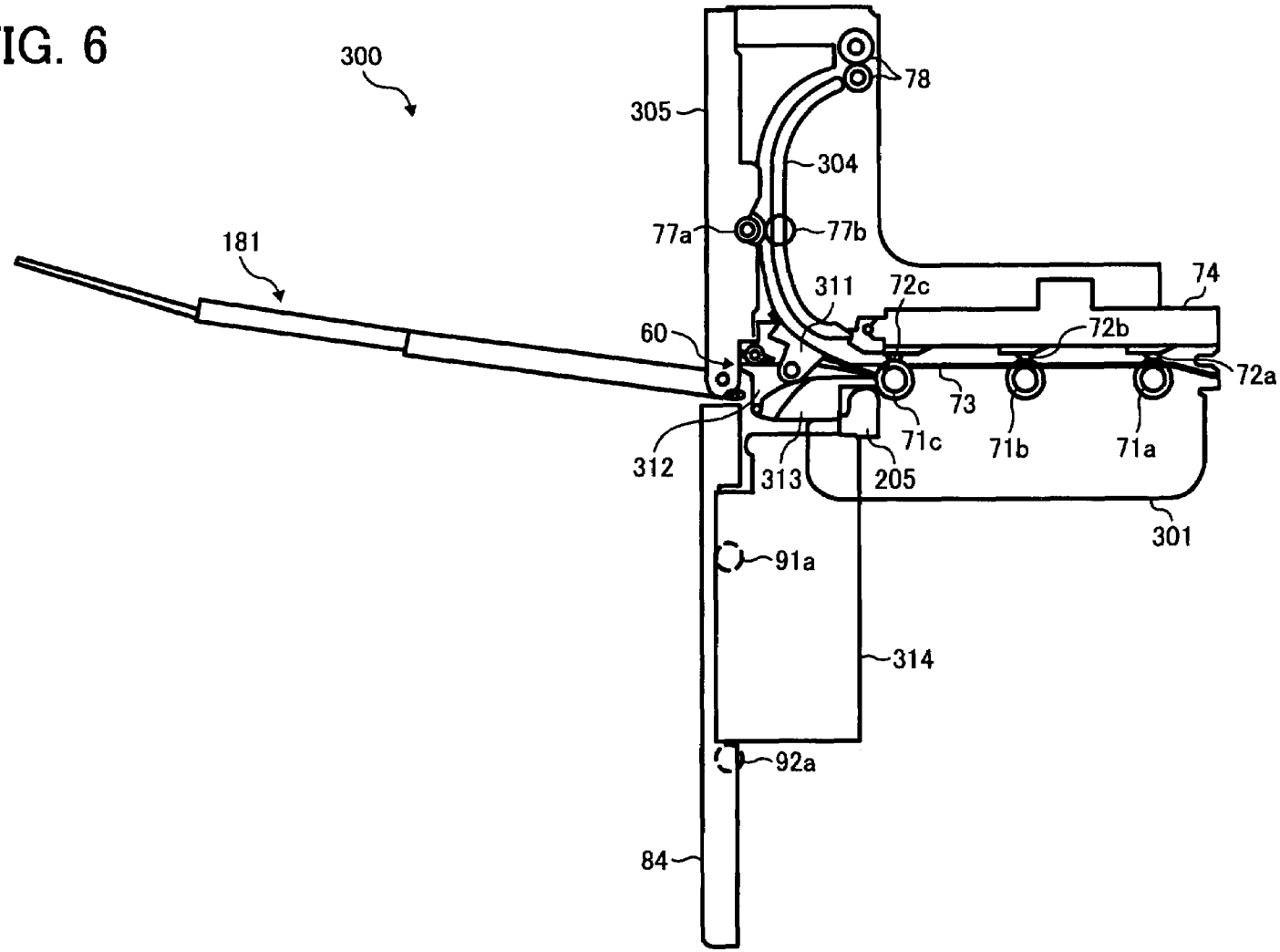
FIG. 6 is a sectional view of FIG. 5.

Examples of the output unit 300 are described below referring to FIGS. 5 to 8. In the example of FIGS. 5 and 6, a relatively thick member is illustrated to be thinner for the purposes of explanation.

As illustrated in FIGS. 5 and 6, between side plates 301 and 302, the output unit 300 includes the conveyor rollers 71*a*, 71*b*, and 71*c*, the toothed wheels 72*a*, 72*b*, and 72*c*, and the lower and upper guide members 73 and 74.

In other words, the members forming the conveyance path 70 are unitized as the output unit 300 that is freely attached and detached from the body 1. When the sheet 5 immediately after an image formation soils a part of the conveyance path 70 with recording liquid, the output unit 300 may be removed from the body 1 for cleaning. As a result, a maintenance for recovering a sheet output function may be facilitated.

The output unit 300 further includes a side guide plate 304 forming the first path 81, a door 305 that can be opened and closed, the face-down roller pair 77 (shown as 77*a* and 77*b*), a the output roller pair 78, a hold-down mechanism 306, a detection lever 307, a sensor 308, and the output sensor 206, the diversion mechanism 60, and the straight output tray 181. The detection lever 307 and the sensor 308 are sensors to detect a full status of the output tray 8.

The output unit 300 further includes the duplex guide plate 84, an entrance roller 91*a* of the entrance roller pair 91 and an exit roller 92*a* of the exit roller pair 92 held by the duplex guide plate 84 to be freely rotated.

In other words, the output unit 300 includes the first path 81, the second path 82, and the third path 83, through which the sheet 5 is conveyed. Since the output unit 300 may be removed from the body 1, the members forming the first path 81, the second path 82, and the third path 83 can be relatively easily maintained when being soiled.

In particular, the first path 81 can have a relatively long distance so as to dry the sheet 5 before the sheet 5 is ejected out of the body 1, thus having relatively many possibly soiled portions. Since the output unit 300 may be removed from the body 1, a maintenance of the first path 81 is facilitated.

Further, since the straight output tray 181 is included in the output unit 300, the members in need of a maintenance in the output unit 300 may be removed without removing the straight output tray 181.

As illustrated in FIG. 6, the diversion mechanism 60 can have a first claw 311, a second claw 312, a guide member 313, and a solenoid 314. The first claw 311 switches between the first path 81 and the second path 82. The second claw 312, when driven by the solenoid 314, may switch a path to the third path 83, which is formed by the guide member 313.

When the solenoid 314 is turned OFF and the straight output tray 181 is closed, the diversion mechanism 60 forms a path to the first path 81.

When the solenoid 314 is turned OFF and the straight output tray 181 is opened, an opening is formed between an upstream side of the first claw 311 and the second claw 312 via an interlock mechanism (not shown). As a result, the diversion mechanism 60 forms a path to the second path 82.

When the solenoid 314 is turned ON, an opening is formed between upstream sides of the first and second claws 311 and 312, and the guide member 313. Thus, the diversion mechanism 60 forms a path to the third path 83.

Since the diversion mechanism 60 is included in the output unit 300, the members forming the diversion mechanism 60 described above may be relatively easily removed for maintenance.

Figure 7:
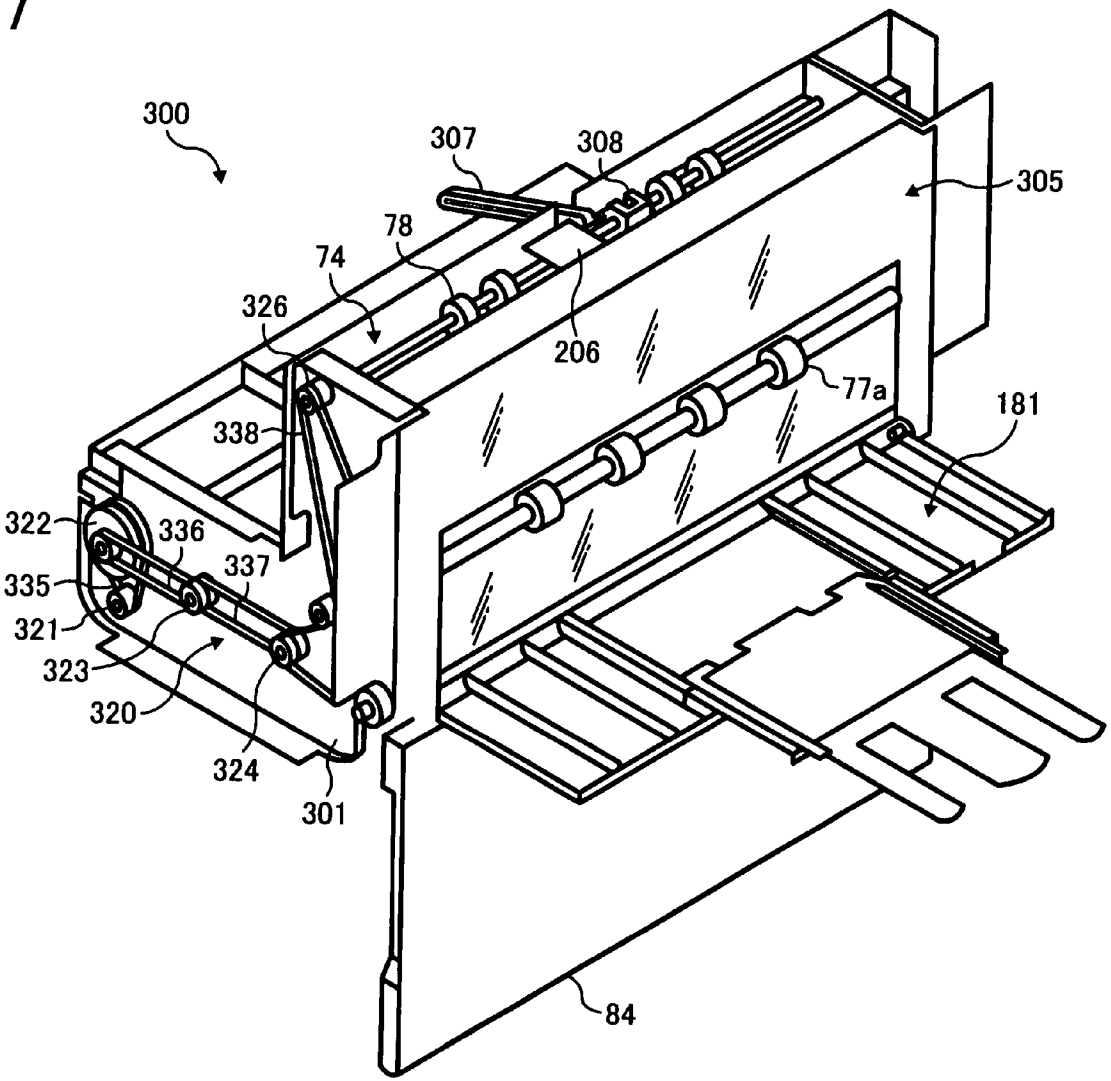
FIG. 7 is a perspective rear view of the output unit of FIG. 5.
Figure 8:
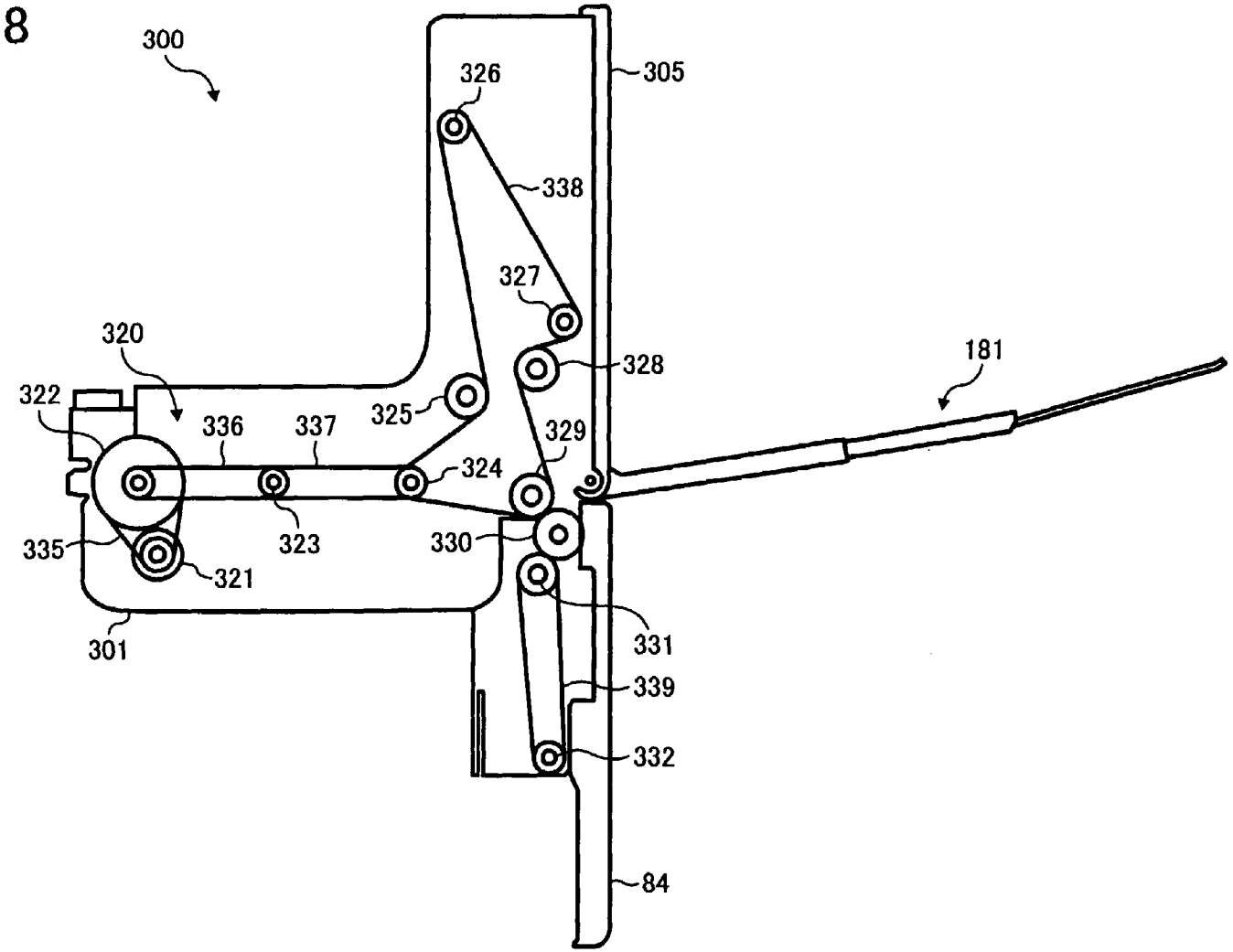
FIG. 8 is a sectional view of FIG. 7.

As illustrated in FIGS. 7 and 8, the side plate 301 can have a drive mechanism 320 including an output motor 321 to which a pulley is attached, a double pulley 322, pulleys 323, 324, 326, 327, 331, and 332, idler pulleys 325, 328, 329, and 330 and timing belts 335 through 339 stretched among the pulleys from 322 through 332.

The double pulley 322, the pulley 323, and the pulley 324 drive the conveyor rollers 71*a*, 71*b*, and 71*c*, respectively. The pulley 326 drives the output roller pair 78. The pulley 327 drives the face-down roller pair 77. The pulleys 331 and 332 drive the entrance roller pair 91 and the exit roller pair 92, respectively.

Since the output unit 300 includes electrical devices such as the output motor 321, the solenoid 314, the sensor 308, and the output sensor 206, the electrical devices may be removed without dismantling for maintenance.

As described above, the output unit 300 may be attached and detached from the body 1 in the sub-scanning direction (i.e. the sheet-conveying direction of in the image forming section 2). Therefore, the output unit 300 may be more easily attached and detached than the output unit 300 that is designed to be removed from a direction perpendicular to the sub-scanning direction, particularly when the output 300 includes the output tray 8.

The output unit 300 may also include the output tray 8, although not included in the output unit 300 of the example embodiment.

The above-described examples and exemplary embodiments are illustrative, and numerous additional modifications and variations are possible without departing from the spirit of the disclosure or from the scope of the appended claims. For example, elements and/or features of different examples and illustrative embodiments may be combined with each other within the scope of this disclosure and appended claims.

This patent specification is based on Japanese patent applications, No. 2005-039658 filed on Feb. 16, 2005 and No. 2005-355670 filed on Dec. 9, 2005 in the Japan Patent Office, the entire contents of which are incorporated by reference herein.

What is claimed is:

1. An image forming apparatus, comprising:

an image forming section including a recording head configured to discharge droplets of recording liquid to form an image on a recording medium;

a body including the image forming section;

a feed tray configured to feed the recording medium to a conveyance path through the image forming section;

a duplex unit configured to reverse the recording medium to re-feed the recording medium to the image forming section;

a conveyor section configured to convey and output the recording medium having thereon the image formed in the image forming section; and an output unit removably attached to the body and including at least the conveyor section, wherein the output unit includes:

a face-down output path configured to output the recording medium face down;

a straight output tray;

a straight output path configured to output the recording medium face up onto the straight output tray;

a duplex output path configured to output the recording medium to the duplex unit; and a diversion section configured to switchably divert the recording medium to a selected one of the face-down output path, the straight output path, and the duplex output path, the diversion section including a first claw to switch between the face-down output path and the straight output path, and a second claw to switch to the duplex output path; and wherein the recording medium is linearly conveyed from the feed tray through the conveyance path and straight output path to the straight output tray, the droplets of recording liquid are discharged by the recording head onto the recording medium on the conveyance path to form the image on the recording medium, and the image-bearing recording medium is linearly conveyed from the conveyance path through the straight output path onto the straight output tray.

2. The image forming apparatus of claim 1, wherein the output unit including the conveyor section is configured to be detachable from the body and then reattached to the body after maintenance and/or cleaning thereof.

3. The image forming apparatus of claim 1, wherein the output unit may be drawn out of the body in a direction in which the recording medium is conveyed in the image forming section.

4. The image forming apparatus of claim 1, wherein the output unit further includes a conveyor device including a roller member configured to convey the recording medium.

5. The image forming apparatus of claim 4, wherein the output unit includes an electric component that may drive the conveyor device to convey the recording medium.

6. The image forming apparatus of claim 1, wherein the duplex output path of the diversion section is diverged from the straight output path inside the output unit.

* * * * *